United States Patent [19]

Hatley

[11] Patent Number: 4,688,839

[45] Date of Patent: Aug. 25, 1987

[54] CARGO CONTAINER LIFT DEVICE

[76] Inventor: John F. Hatley, 5452 40th Ave. West, Seattle, Wash. 98199

[21] Appl. No.: 845,962

[22] Filed: Mar. 31, 1986

[51] Int. Cl.[4] ..... B66C 1/00

[52] U.S. Cl. ..... 294/81.21; 294/1.1; 294/81.1

[58] Field of Search ..... 294/1.1, 64.1, 65.5, 294/66.1, 67.7, 68.3, 81.1, 81.21, 81.5, 81.53, 82.1, 82.24, 86.4, 86.34; 15/302, 303, 312 R; 239/289

[56] References Cited

U.S. PATENT DOCUMENTS

| | | | |
|---|---|---|---|
| 690,742 | 1/1902 | Kovacs . | |
| 841,317 | 1/1907 | Flowers et al. . | |
| 1,465,652 | 8/1923 | Moore . | |
| 3,321,793 | 5/1967 | Braunger | 15/303 X |
| 3,514,146 | 5/1970 | Zweifel et al. | 294/81.21 |
| 3,697,746 | 10/1972 | Patterson et al. . | |
| 3,944,273 | 3/1976 | Ahlstone | 294/86.34 X |
| 3,986,745 | 10/1976 | Langguth | 294/66.1 |
| 4,006,732 | 2/1977 | Schumm . | |

FOREIGN PATENT DOCUMENTS

| | | | |
|---|---|---|---|
| 45512 | 2/1982 | European Pat. Off. | 294/86.4 |
| 2270189 | 12/1975 | France . | |
| 481523 | 8/1975 | U.S.S.R. | 294/81.53 |
| 927718 | 5/1982 | U.S.S.R. | 294/81.53 |

*Primary Examiner*—Johnny D. Cherry

*Attorney, Agent, or Firm*—Graybeal, Jensen & Puntigam

[57] ABSTRACT

An air blast device for removing moisture, snow, sleet and the like from the top surfaces of cargo containers. The device is usable with a substantially conventional container lifting device having a frame with extendable and contractable spreader arms. When lifting a container, the frame is disposed in close proximity above the top surface of the container, and detachably connected thereto. Three hollow air blast members are arranged on the frame extending the entire length thereof adjacent the top surface of the container. Two outermost air blast members are movable with the spreader arms of the frame. Each air blast member contains an air discharge opening through the lower portion thereof adjacent the top surface of the container. When air is supplied to the air blast members from an external air supply under the control of the operator, a blast of air is directed from the discharge openings over and against substantially the entire top surface of the container to remove moisture, snow, sleet, ice and the like therefrom.

11 Claims, 7 Drawing Figures

CARGO CONTAINER LIFT DEVICE

BACKGROUND OF THE INVENTION

Very substantial investments of time, labor and capital are involved in the providing of cargo ships designed to carry deck loads of loaded containers and which containers are loaded with cargo. The purpose of both the ships and the containers is to reduce to an absolute, the minimum time that a vessel must stay berthed to be loaded and/or unloaded.

The containers are carried on the decks of the particularly fitted cargo container vessel so that the containers may be readily engaged by the loading/unloading apparatus and discharged on the dockside and so that containers located on the dockside can be readily engaged by the overhead loading/unloading apparatus and readily placed in storage on the ship's deck.

In the interest of maximum proficiency, or use of minimum time in the loading or unloading of the containers from the vessel, the containers must at all times be exposed to prevailing weather conditions, such as rain, sleet, ice, and the like, all of which fall on structures open to overhead loading and unloading members or devices.

During the attaching and detaching of the loading or unloading devices with the cargo compartments, it is necessary for manual labor to get on top of the containers and to assist in the detaching and attaching of the loading/unloading mechanism with the top portions of the cargo container.

If the weather is adverse, such as by reason of falling snow, or sleet, or hail, or water, then the longshoremen usually delay in getting on top of the containers, or the container loading mechanism, to make, or release, the appropriate necessary mechanical connections in the loading or unloading operations or else the longshoremen go very slowly about the work once they are on the top of the container or the container loading mechanism. The end result is that under present-day practices, it takes a longer time period to load or unload containers to or from a vessel during adverse weather conditions than it does to do the same during fair weather conditions and one primary fact of this is the slowness of the longshoremen in the making or in the breaking of the connection between the loading mechanism and the containers.

It is an object of my invention to provide means to employ air under pressure directed toward the top of the container so that the top of the container and the top of the loading mechanism is kept clear of falling snow, hail, sleet, and ice and the like with resultant decrease of the ship's dock time by reason of human delays resulting from inclement weather conditions during the loading and unloading operations.

Various objects, advantages and the utilities of my invention will become implicit and explicit as the description of my invention proceeds in connection with the following drawings of my invention, wherein like reference numerals will refer to like parts.

DESCRIPTION OF A PREFERRED EMBODIMENT OF MY INVENTION

Figures 1, 4, 5, 6:
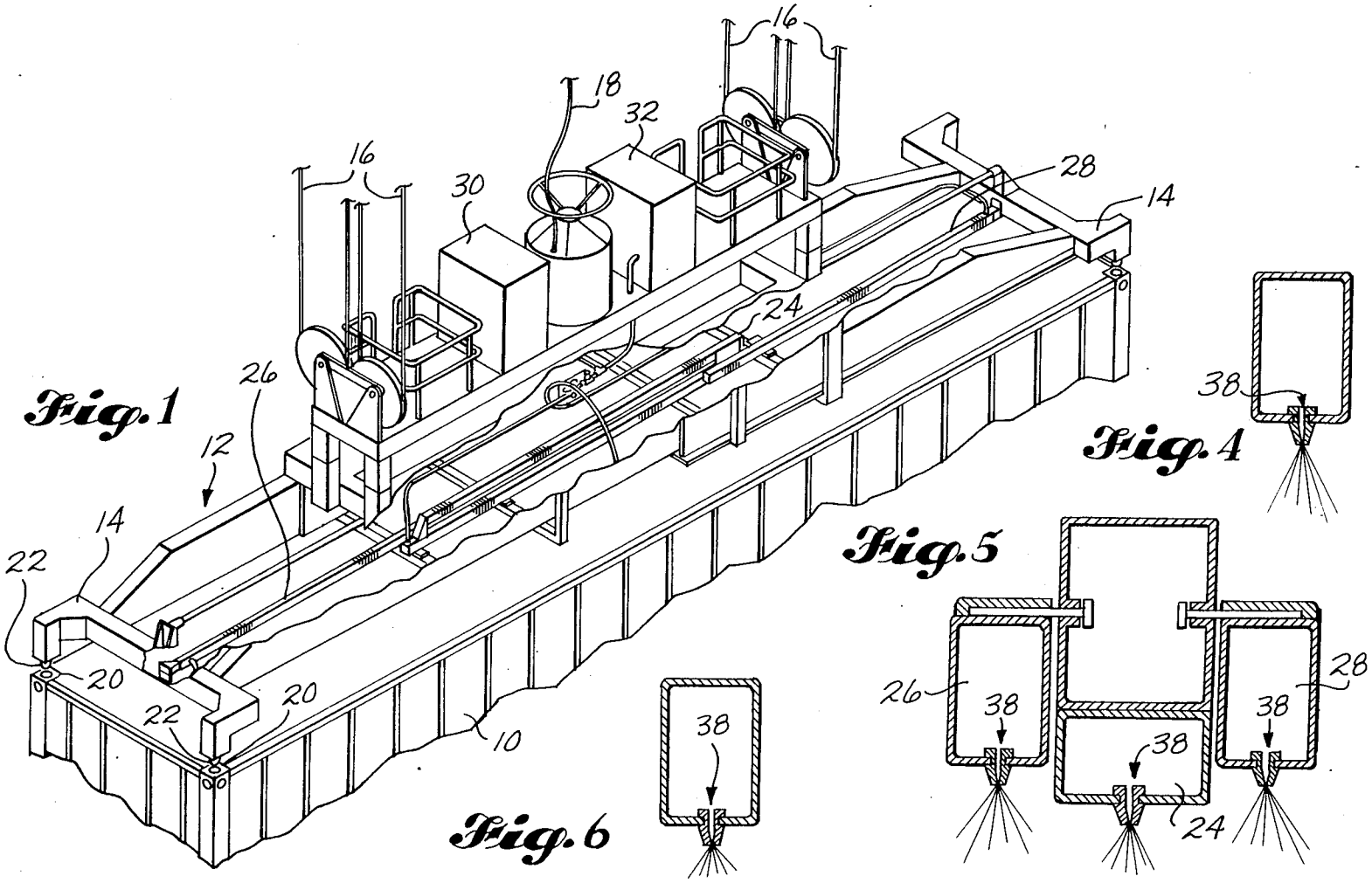
FIG. 1 is a perspective view, with parts broken away, showing my invention as applied to a cargo container and cargo container lifting unit.
FIG. 4 is a sectional view taken substantially on 4—4 of FIG. 3.
FIG. 5 is a sectional view taken substantially on 5—5 of FIG. 3.
FIG. 6 is a sectional view taken substantially on 6—6 of FIG. 3.
Figure 2:
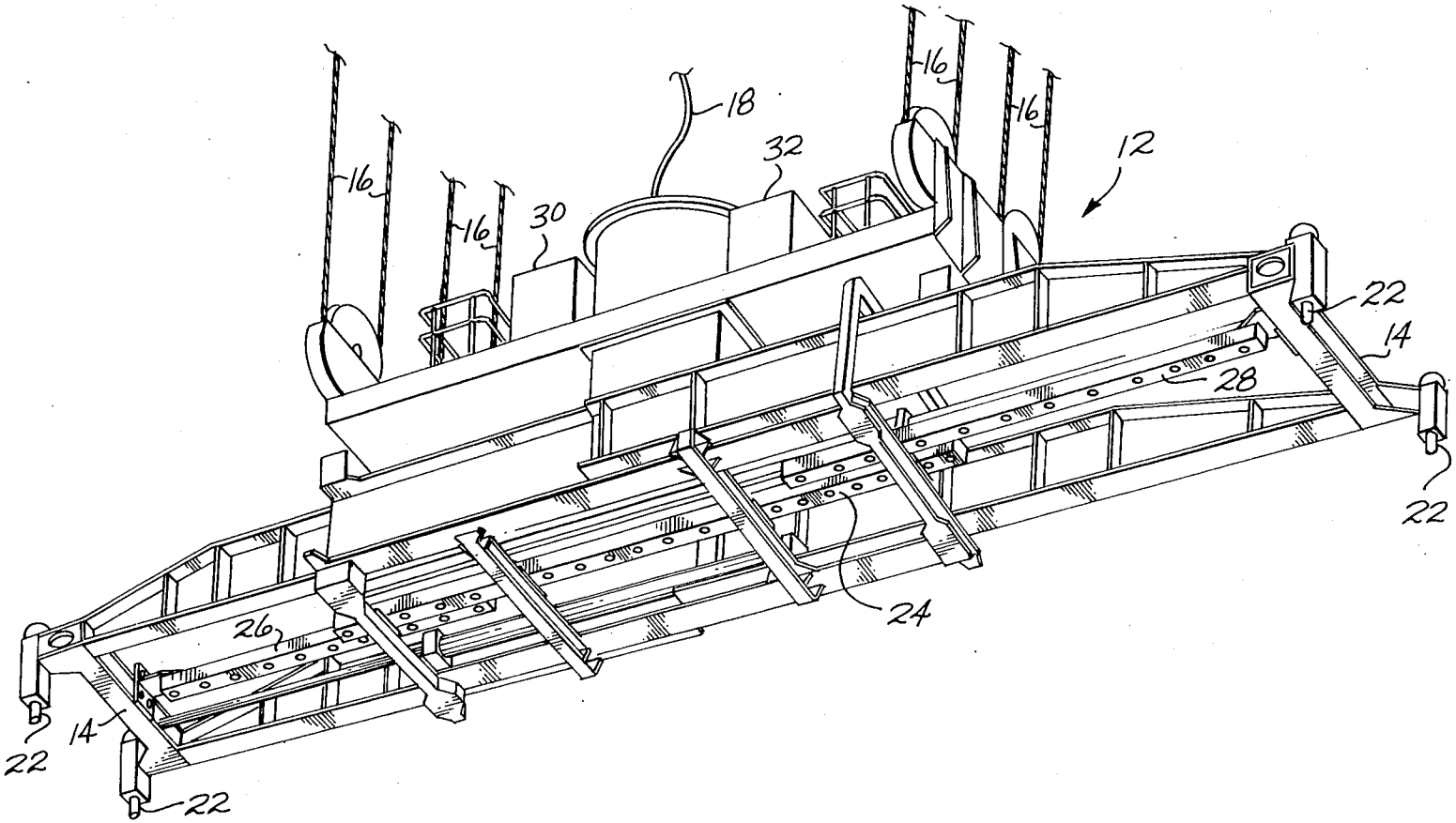
FIG. 2 is a perspective view showing my invention detached.
Figures 3, 7:
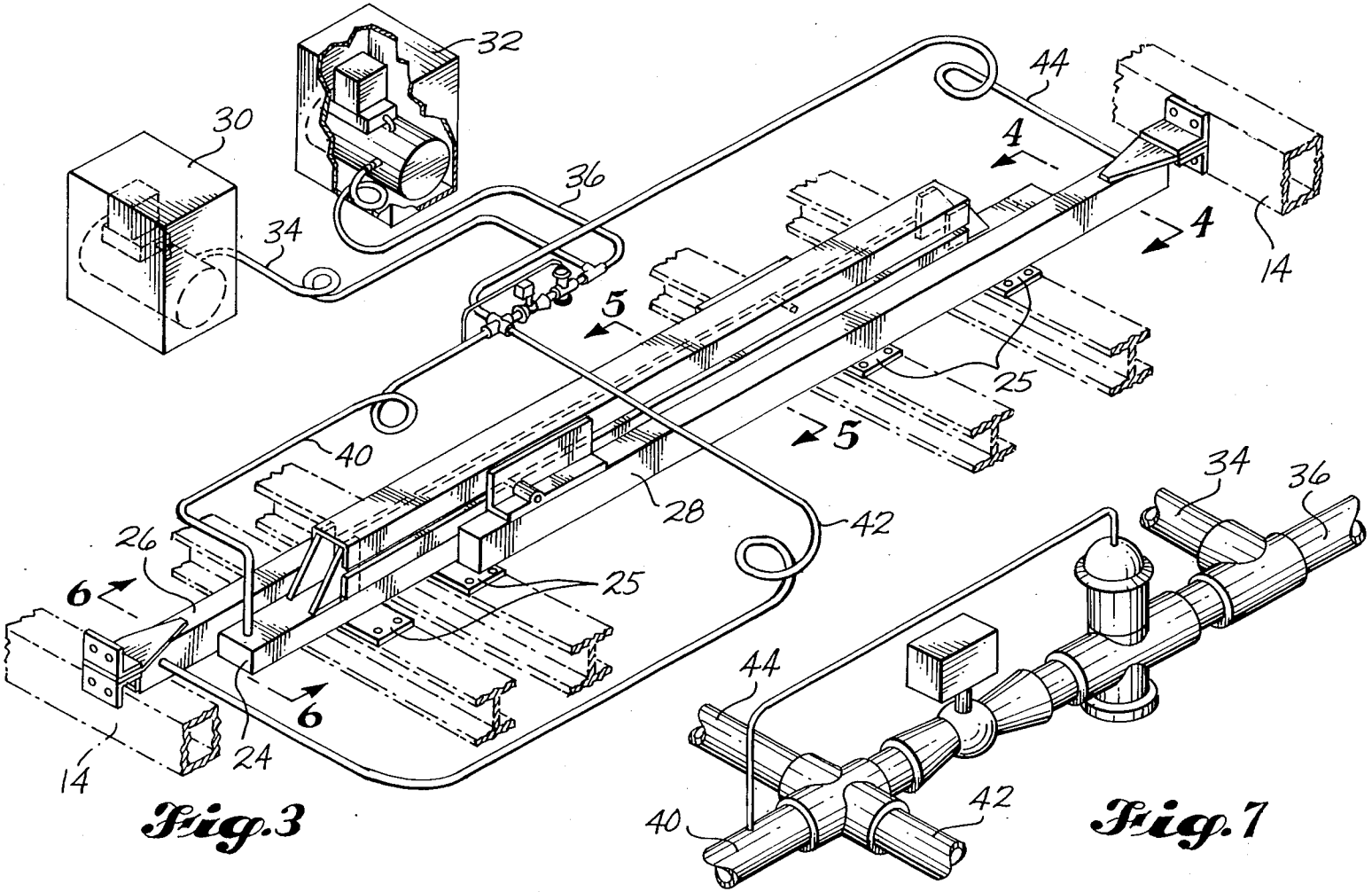
FIG. 3 is a somewhat schematic view showing the air flow employed in my invention to blow away snow, rain, sleet, ice resulting from inclement weather.
FIG. 7 is an enlarged, detached view of connection means employed in the air control conduit means.

A fragment of a ship's cargo container 10 is shown in FIG. 1. These containers are now standard either at 20 foot or 40 foot in most ports of the world and there are quite a number at 25 foot. Thus, the cargo container lifting device, generally number 12, has spreader arms 14 which must be extensible and contractible so as to be able to be attached to cargo containers having varying lengths.

Parts shown and which are illustrative of standard construction in FIG. 1 include hoisting cables 16; control cable 18; connector means 20, generally in the nature of a slot carried at each of the four corners of the container top; and key means 22 carried by the cargo container lifting means and movable into and out of locking engagement with the slot connector means 20. Through control means extending through cable 18, an operator is able to manipulate the cargo container lifting device 12 and connect the same with the cargo container 10. Many times, such as during the preparation to engage or disengage the cargo container lift means 12 to or from the cargo container 10, men must be present on the top of the apparatus and ensure that each of the connector means 22 carried by the lifting device positively and securely engages with the connector means 20 carried by the corners of the container. If the loading is underway during adverse weather conditions, such as rain, snow, sleet, ice, and the like, then the men are either wary upon getting on top of the container to visually inspect the accuracy and positioning of parts, or they are very slow in their work after they once get there. Time is here lost and the very purpose of the whole cargo container and cargo container ships is lost in that ships are being held up during the loading and unloading operations rather than having the same promptly proceed regardless of the external weather conditions.

Now referring more specifically to the device embodying my invention (see FIGS. 3 to 7), there are preferably three separate tubular members or chambers, or air blast members, for distributing of air under pressure to various portions of the upper surface of the cargo container 10. A central air blast member 24 may be of definite length, such as 20 feet, or the length of the shortest cargo container to be encountered. This member 24 has both ends relatively fixed or secured to the cargo container lifting device 12, as by cleats 25. Two additional air blast members 26 and 28 are provided and each thereof has only one end portion secured with a relatively inner end portion of the cargo container lifting device 12. The outer end portion of each of the air blast members 26 and 28 is connected with the outer portions of the spreader arms 14. Thus, if the spreader arms 14 are fully extended (to interfit with the cargo lifting device when the same is spread to interfit with a 40-foot cargo container), the air blast members 26 and 28 will be aligned with the outer ends of the cargo container 10 to spray air under pressure thereagainst when the device is to fit with a 40-foot container 10. When the device is used with a 20-foot container 10, then the spreader arms 14 and the air blast members 26 and 28 are of the same length.

The air blast members 24, 26 and 28 are rectangular in section and the lower level or base of the air blast member 24 extends below the lower levels or bases of air blast members 26 and 28. This provides for reflection of air from the air nozzles in air blast members 26 and 28 and direct flow from the nozzles of air blast member 24, thus providing complete air blasting and providing for lateral deflection of air.

As illustrative of a means to provide air under pressure to keep the top of the cargo container 10 clear of snow, sleet, ice, and the like because of foul weather during the loading and unloading operations, preferably a source, and standby source, of compressed air under pressure is provided. This is diagrammatically illustrated by structures 30 and 32, respectively. Subject to manual control of the operator, air, under pressure, is delivered from source 30 via conduits 34 and 36 to the air blast members or conduits 24, 26 and 28. The undersides, or sides adjacent the cargo container 10 of the blast members 24, 26 and 28, are provided with spaced apart air blast openings or nozzles 38 (FIG. 5) suitably directing air to encompass the entire upper surface of the cargo container 10 being loaded or unloaded, with appropriate strength of air under pressure directed through members 24, 26 and 28 and through the air blast extended holes 38 which are disposed in a pattern which is parallel to the length of cargo container 10 and which holes 38 direct air against the suitable portions of the top surface of the cargo container 10. Thus, falling ice, snow, sleet, and the like can be kept off the upper deck of the cargo container 10 during the loading and unloading operations of the same and thus, prevent adverse conditions against workers moving about and properly manipulating and supervising the operation, all this during even the most adverse weather condition because of the air blase driving away the falling particles.

As illustrative of a way air under pressure may be delivered from a source of air under pressure to air blast slots 38, I have illustrated (see FIGS. 3 to 7) two pump-and-storage-tank units 30 and 32. The air output from these units is delivered by conduits 34 and 36 to a valving control mechanism shown in FIG. 7 and with three separate pressure conduits 40, 42 and 44 providing, respectively, air under pressure to air blast members 24, 26 and 28. As mechanism to provide air under pressure to an enclosure is well known in the art, the drawing and description of the same are illustrative and only briefly described.

SUMMARY

Thus, I have, in general, provided for a lifting device 12 for a cargo container 10 and detachable means in the nature of spreader arms 14 to selectively connect and disconnect the lifting device to and from the cargo container 10. Air conduit means 34, 36 having slots 38 are carried by the lifting device 12 and are connected with a source of air under pressure, illustrated by air blast source members 30 and 32. Each of the air blast members 24, 26, and 28 is provided with an air blast nozzle 38, each of which nozzles 38 is aligned to discharge air under pressure over and against a pattern on the top surface of a cargo container 10 which is being loaded or unloaded from a marine vessel and thus to remove, by said discharging air moisture, snow, sleet, and ice from the top of the cargo container 10 during the loading and unloading of the same from or to a marine vessel regardless of adverse weather conditions occurring at the time of said loading and unloading.

More specifically, I provide for the air spraying and thus removal, during foul weather of falling snow, sleet and ice from the top portion of a cargo container during the loading or unloading operation and even this during most extreme foul weather.

The air-under-pressure system also preferably includes a central air blast member 24, which is approximately the length of the shortest cargo container to be processed and additional air blast members 26 and 28, each having a length of approximately 10 feet. The air blast members 24, 26 and 28 are thus, preferably 20 foot and 10 foot in length and are positioned parallel to each other and also extend parallel to the longer side of the cargo containers.

Obviously, changes may be made in the forms, dimensions, and arrangement of the parts of my invention without departing from the principle thereof, the above setting forth only preferred forms of embodiment.

I claim:

1. In combination with a lifting device for a cargo container having a frame adapted to be disposed over and in close proximity to a top surface of a cargo container, and means for detachably connecting the frame with the container, a cargo container clearing device comprising:

air chamber means carried by said frame for receiving pressurized air from a source of air under pressure; and air discharge means connected with said air chamber means and aligned to discharge air over and against substantially the entire length of the top surface of the container and to remove, by said discharging air, moisture, snow and sleet from the top surface of the container.

2. The combination of claim 1, wherein the air chamber means comprises a plurality of hollow air chambers extending substantially parallel to the top surface of the container.

3. The combination of claim 2, wherein the top surface of the cargo container is rectangular with a length greater than its width and the air chambers extend parallel to the length of the container and the air discharge means from said air chambers are slots disposed in patterns which extend parallel to the length of the cargo container.

4. The combination of claim 2, wherein a selected one of the air chambers has opposite end portions thereof connected with said frame.

5. The combination of claim 4, wherein the frame is extendable and contractable, and wherein two of said air chambers each have an outer end portion thereof connected with a respective extendable and contractable outer end portion of said frame.

6. The combination of claim 5, wherein the air chambers are rectangular in section, are elongate, and are positionable in close proximity to each other along at least portions of the lengths thereof, and wherein a lower wall or base of a selected first air chamber is positioned substantially lower than the lower wall or base of a proximal second air chamber so that a side wall of said first air chamber tends to laterally deflect air discharged from said second air chamber.

7. In an extendable lifting device for cargo containers, said lifting device having a frame, and means for detachably connecting the frame with the container to enable the lifting device to lift the container, the improvement comprising:

air chamber means for receiving pressurized air or other gas from a source of air or other gas under pressure, said air chamber means being arranged on the frame to be substantially adjacent the top surface of the container when the frame is disposed over and in close proximity to said surface of the container, and said air chamber means having one or more air discharge openings therein aligned to discharge air from said air chamber means over and against substantially the entire length of the top surface of the container.

8. The improvement of claim 7, wherein a portion of the frame is extendable and contractable with respect to a remaining portion of the frame, and wherein a portion of the air chamber means is adapted for movement together with the extendable and contractable portion of the frame.

9. The improvement of claim 7, wherein the air chamber means comprises three substantially tubular members extending parallel to the top surface of the container, and the air discharge openings comprise longitudinal slots in said tubular members.

10. The improvement of claim 9, wherein opposed outer portions of the frame are extendable and contractable with respect to a remaining central portion of the frame, and wherein a first air chamber is relatively fixed to the central portion of the frame and each of the second and third air chambers is adapted to move together with a respective outer portion of the frame.

11. An improved cargo container lifting device, comprising:

an extendable and contractable frame; and air chamber means carried by said frame for receiving pressurized air from a source of air under pressure, said air chamber means having one or more openings therein aligned to discharge air over and against substantially the entire length of the top surface of the container when the frame is disposed over and in close proximity to the top surface of the container.

* * * * *